US010968077B2

(12) United States Patent
Dube

(10) Patent No.: US 10,968,077 B2
(45) Date of Patent: Apr. 6, 2021

(54) ENHANCED GOVERNOR SYSTEM FOR ELEVATOR

(71) Applicant: Otis Elevator Company, Farmington, CT (US)

(72) Inventor: Randall S. Dube, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 284 days.

(21) Appl. No.: 16/040,361

(22) Filed: Jul. 19, 2018

(65) Prior Publication Data

US 2020/0024106 A1 Jan. 23, 2020

(51) Int. Cl.
*B66B 5/04* (2006.01)
*B66B 5/18* (2006.01)

(52) U.S. Cl.
CPC ..... *B66B 5/044* (2013.01); *B66B 5/18* (2013.01)

(58) Field of Classification Search
CPC ..... B66B 5/044; B66B 5/18
See application file for complete search history.

(56) References Cited

U.S. PATENT DOCUMENTS 3,327,811 A * 6/1967 Mastroberte ..... B66B 5/044 187/305
4,662,481 A 5/1987 Morris et al.
5,217,091 A * 6/1993 Shiina ..... B66B 5/044 187/351
5,299,661 A * 4/1994 Pramanik ..... B66B 5/044 187/373
5,492,200 A * 2/1996 Korhonen ..... B66B 5/044 187/350
5,653,312 A * 8/1997 Kato ..... B66D 5/16 187/350
6,360,847 B1 * 3/2002 Okada ..... B66B 5/044 187/373
6,619,435 B1 * 9/2003 Watzke ..... B66B 5/04 187/373

(Continued)

FOREIGN PATENT DOCUMENTS

CN 1612838 A 5/2005
CN 1878715 A 12/2006

(Continued)

OTHER PUBLICATIONS

WO2012086026—Machine Translation (Year: 2012).*

(Continued)

*Primary Examiner* — Michael A Riegelman
(74) *Attorney, Agent, or Firm* — Cantor Colburn LLP

(57) ABSTRACT

An overspeed assembly for use with a governor assembly for limiting of an elevator system, the overspeed assembly includes a rod movable relative to the governor assembly in response to a speed of an elevator car and a pin coupled to the rod. The pin is movable between a first position and a second position based on a direction of travel of the elevator car. The pin is configured to engage a first component to indicate a first overspeed condition when the elevator car is travelling in a first direction and the pin is configured to engage a second component to indicate a second overspeed condition when the elevator car is travelling in a second, opposite direction.

14 Claims, 6 Drawing Sheets

(56) References Cited

U.S. PATENT DOCUMENTS

| | | | | |
|---|---|---|---|---|
| 7,607,516 | B2 * | 10/2009 | Simon | B66B 5/0043 187/285 |
| 8,181,749 | B2 * | 5/2012 | Okada | B66B 5/044 187/287 |
| 8,950,554 | B2 | 2/2015 | Niikawa | |
| 9,359,173 | B2 * | 6/2016 | Dube | B66B 5/044 |
| 2003/0042079 | A1 * | 3/2003 | Sanchez | B66B 5/044 187/373 |
| 2010/0025646 | A1 * | 2/2010 | Dube | B66B 5/044 254/391 |
| 2011/0272217 | A1 * | 11/2011 | Niikawa | B66B 5/044 187/305 |
| 2015/0136544 | A1 * | 5/2015 | Dube | F16D 3/12 188/180 |
| 2017/0073189 | A1 * | 3/2017 | Dube | B66B 5/18 |
| 2017/0152126 | A1 * | 6/2017 | Dube | B66B 9/00 |
| 2017/0190545 | A1 * | 7/2017 | Dube | B66B 5/044 |
| 2018/0029828 | A1 * | 2/2018 | Shi | B66B 5/044 |
| 2018/0118515 | A1 * | 5/2018 | Shi | B66B 5/044 |
| 2018/0319626 | A1 * | 11/2018 | Shiraishi | B66B 5/044 |
| 2020/0024106 | A1 * | 1/2020 | Dube | B66B 5/044 |
| 2020/0115189 | A1 * | 4/2020 | Dube | B66B 5/20 |

FOREIGN PATENT DOCUMENTS

| | | | |
|---|---|---|---|
| CN | 103261072 | A | 8/2013 |
| CN | 106276465 | A | 1/2017 |
| EP | 2602222 | A1 | 6/2013 |
| JP | 4326255 | B2 | 9/2009 |
| JP | 5577736 | B2 | 8/2014 |
| JP | 5870165 | B2 | 2/2016 |
| WO | 2012086026 | A1 | 6/2012 |
| WO | 2013179336 | A1 | 12/2013 |
| WO | 2015159375 | A1 | 4/2017 |
| WO | 2015198384 | A1 | 4/2017 |

OTHER PUBLICATIONS

Chinese Office Action; International Application No. 201910650001.3; International Filing Date: Jul. 18, 2019; dated Jul. 30, 2020; 7 pages.

Extended European Search Report; International Application No. 19187443.7-1017; International Filing Date: Jul. 19, 2019; dated Dec. 9, 2019; 69 pages.

* cited by examiner

ENHANCED GOVERNOR SYSTEM FOR ELEVATOR

BACKGROUND

Embodiments of this disclosure relate generally to an elevator system, and more particularly to a governor that reacts to a different speeds when the elevator car is moving in an up direction versus a down direction.

Elevator systems include a variety of devices for providing control over movement of the elevator car. Elevator governors for protecting against over speed conditions are well known. Most elevator governors include a centrifugal mechanism located near the top of the hoistway. A governor rope extends along the length of the hoistway wrapping around a governor sheave associated with the centrifugal mechanism and an idler sheave associated with a tension weight near an opposite end of the hoistway. The elevator car is connected with the rope so that the rope moves as the elevator car moves. If the elevator car moves at a speed that is higher than desired, the speed of rotation of the governor sheave activates the centrifugal mechanism.

Governors in elevators systems are used for two purposes. One use of an elevator governor is for activating or dropping the machine brake and interrupting power to the machine motor in the event of an over speed condition. The other use is for activating elevator safeties that engage the guide rails, for example, in the event of a further over speed condition. Typically, elevator governors react to activate or drop the machine brake and interrupt power to the machine motor at nearly the same over speed condition, regardless of whether the elevator is travelling upwards or downwards within the hoistway. However, in high rise buildings where the elevators travel at high speeds, it may be desirable to have different overspeed conditions depending on the direction of travel of the elevator car.

BRIEF DESCRIPTION

According to an embodiment, an overspeed assembly for use with a governor assembly for limiting of an elevator system, the overspeed assembly includes a rod movable relative to the governor assembly in response to a speed of an elevator car and a pin coupled to the rod. The pin is movable between a first position and a second position based on a direction of travel of the elevator car. The pin is configured to engage a first component to indicate a first overspeed condition when the elevator car is travelling in a first direction and the pin is configured to engage a second component to indicate a second overspeed condition when the elevator car is travelling in a second, opposite direction.

In addition to one or more of the features described above, or as an alternative, in further embodiments the first overspeed condition and the second overspeed condition are distinct.

In addition to one or more of the features described above, or as an alternative, in further embodiments the pin is oriented substantially perpendicular to the rod.

In addition to one or more of the features described above, or as an alternative, in further embodiments the elevator car is travelling in the first direction, the pin is in the first position and when the elevator car is travelling in the second direction, the pin is in the second position.

In addition to one or more of the features described above, or as an alternative, in further embodiments the pin further comprises a first magnet, and the overspeed assembly includes a second magnet, the second magnet being selectively operable to attract and repel the first magnet to move the pin between the first position and the second position.

In addition to one or more of the features described above, or as an alternative, in further embodiments comprising a controller operably coupled to the second magnet, wherein the controller energizes the second magnet to attract and repel the first magnet in response to a direction of travel of the elevator car.

In addition to one or more of the features described above, or as an alternative, in further embodiments the governor assembly further comprises: a governor sheave and a centrifugal mechanism movably mounted to the governor sheave, the rod being connected to the centrifugal mechanism.

In addition to one or more of the features described above, or as an alternative, in further embodiments the governor assembly further comprises a bell crank lever offset from governor sheave by a distance.

In addition to one or more of the features described above, or as an alternative, in further embodiments the bell crank lever is the first component.

In addition to one or more of the features described above, or as an alternative, in further embodiments comprising a switch operably coupled to the bell crank lever, wherein when the elevator car is travelling in the first direction in the first overspeed condition, the pin engages the bell crank lever to operate the switch.

In addition to one or more of the features described above, or as an alternative, in further embodiments comprising a motor for driving movement of the elevator car, wherein the switch is configured to at least one of interrupt a supply of power to the motor and apply a brake to the motor.

In addition to one or more of the features described above, or as an alternative, in further embodiments comprising an elevator safety operably coupled to the bell crank lever wherein when the elevator car is travelling in the first direction in a third overspeed condition, the pin engages the bell crank lever to engage the elevator safety.

In addition to one or more of the features described above, or as an alternative, in further embodiments the bell crank lever includes a through hole, the pin being receivable within the through hole when the pin is in the second position.

In addition to one or more of the features described above, or as an alternative, in further embodiments comprising a switch positioned adjacent the bell crank lever, wherein when the elevator car is travelling in the second direction in the second overspeed condition, the pin operates the switch.

According to another embodiment, a method of controlling a speed an elevator car within a hoistway includes moving an elevator car in a first direction within the hoistway, operating a switch via engagement between an overspeed assembly and a first component coupled to the switch in response to a first overspeed condition, moving the elevator car in a second direction within the hoistway, extending the overspeed assembly through an opening formed in the first component, and operating another switch via the overspeed assembly in response to a second overspeed condition.

In addition to one or more of the features described above, or as an alternative, in further embodiments the first overspeed condition is different than the second overspeed condition.

In addition to one or more of the features described above, or as an alternative, in further embodiments operating the switch via engagement between an overspeed assembly and a first component in response to a first overspeed condition include further comprises at least one of interrupting a supply of power to a motor operable to move the elevator car and applying a brake to the motor.

In addition to one or more of the features described above, or as an alternative, in further embodiments comprising initiating engagement of at least one elevator safety via engagement between the overspeed assembly and the first component in response to a third overspeed condition.

In addition to one or more of the features described above, or as an alternative, in further embodiments the third overspeed condition is a greater speed than the first overspeed condition.

In addition to one or more of the features described above, or as an alternative, in further embodiments operating another switch via the overspeed assembly in response to a second overspeed condition further comprises at least one of interrupting a supply of power to a motor operable to move the elevator car and applying a brake to the motor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
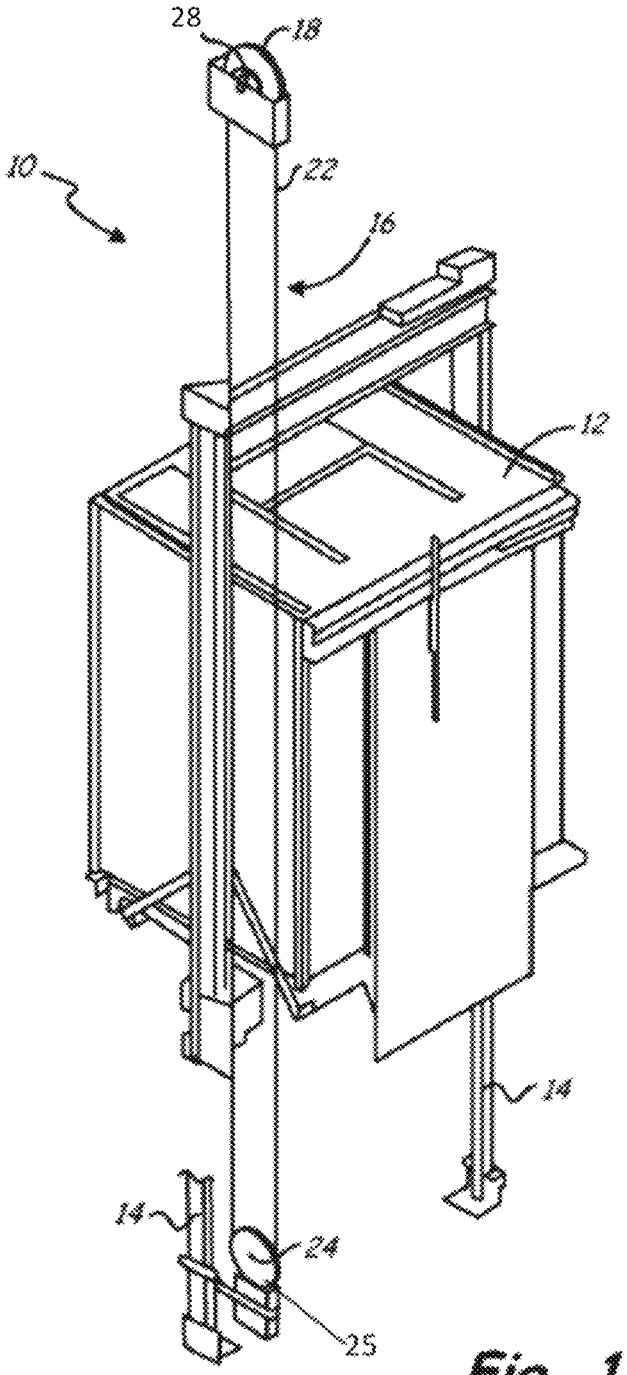
FIG. 1 is a schematic view of a portion of an example of an elevator system.
Figure 2:
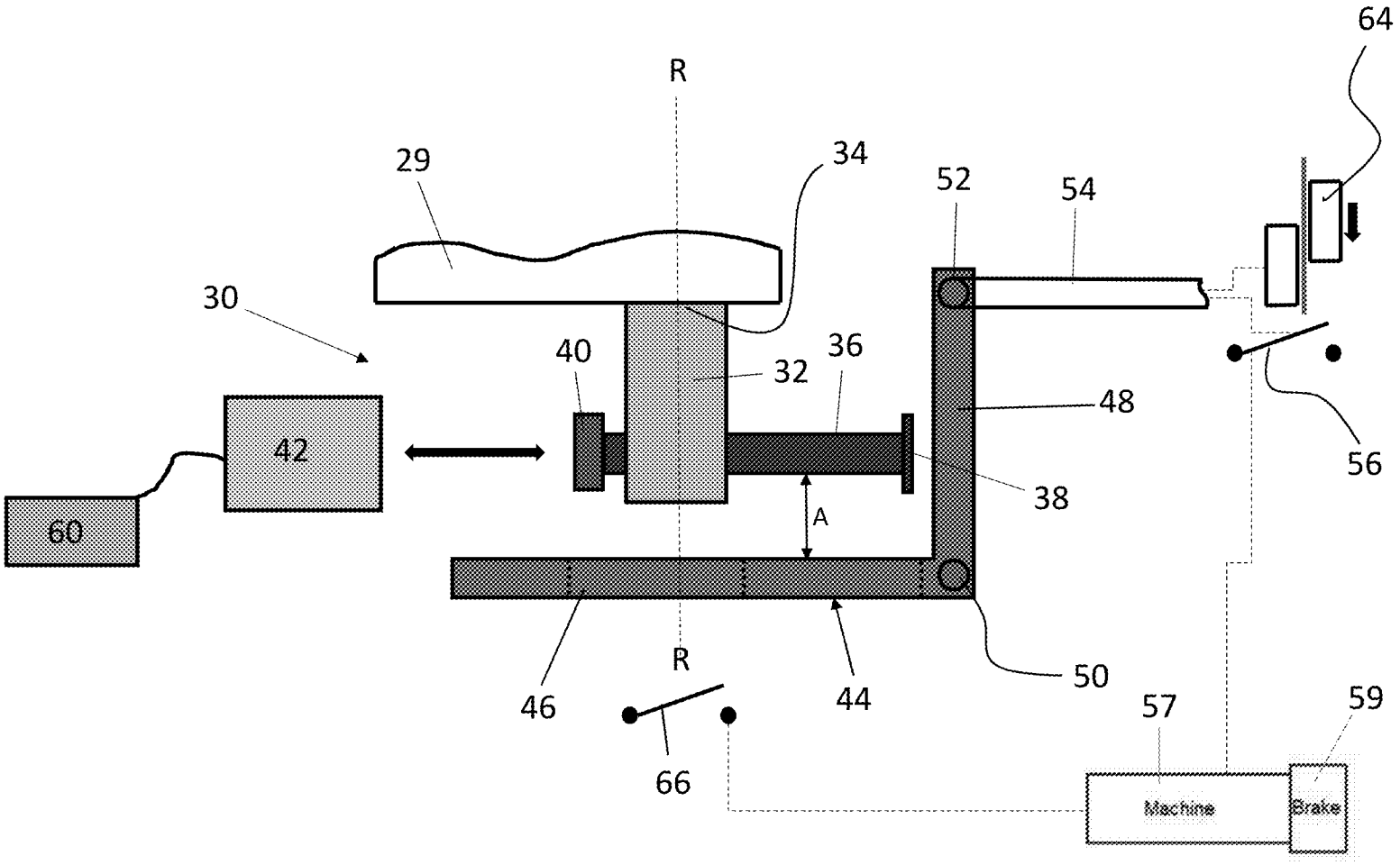
FIG. 2 is a plan view of an overspeed assembly of an elevator system according to an embodiment.

Referring now to FIG. 1, an elevator system including an elevator car 12, guide rails 14, and a governor assembly 16 is illustrated. The governor assembly 16 includes a governor sheave 18, a centrifugal mechanism 28, a rope loop 22, and a rope tensioning assembly 24 including a tensioning sheave 25. The elevator car 12 travels on or is slidably connected to the guide rails 14 and travels within a hoistway (not shown). The governor sheave 18 and the centrifugal mechanism 28 are mounted, in the illustrated, non-limiting embodiment, at an upper end of the hoistway. The rope loop 22 is wrapped partially around the governor sheave 18 and partially around the tensioning sheave 25 (located in this embodiment at a bottom end of the hoistway). The rope loop 22 is also connected to the elevator car 12, thereby ensuring that the angular velocity of the governor sheave 18 is related to the speed of the elevator car 12.

In the elevator system shown in FIG. 1, the governor assembly 16 acts to prevent the elevator car 12 from exceeding a set speed as it travels inside the hoistway. Although the governor assembly 16 shown in FIG. 1 is mounted at an upper end of the hoistway, the location and arrangement of the governor assembly 16 may vary across different embodiments of the present disclosure. For example, the governor assembly 16 may be mounted at any point along the rope loop 22 in the hoistway, including at the bottom, i.e. the pit, of the hoistway. In another embodiment, the governor assembly 16 may alternatively, be mounted to and move with the elevator car 12. Such an alternative embodiment involves a static rope anchored at the top and tensioned by a weight or an elastic member at the bottom of the hoistway and wrapped partially around the tripping sheave 18 and an adjacent idler sheave.

With reference now to FIGS. 2-6, in an embodiment, the centrifugal mechanism 28 is operably coupled to the governor sheave 18. For example, as is known in the art, the centrifugal mechanism 28 may include a connector associated with one or more centrifugal elements 29 configured to rotate with the governor sheave 18 as the elevator car 12 moves. As the elevator car 12 moves, the governor sheave 18 and the centrifugal mechanism 28 rotate. The resulting centrifugal force acting on the one or more centrifugal elements 29 due to this movement of the car 12 causes the connector and the centrifugal elements 29 to move relative to the axis of rotation. The centrifugal mechanism 28 described herein is intended as an example only, and it should be understood that any suitable centrifugal mechanism 28 is within the scope of the disclosure.

An example of an overspeed assembly 30 compatible for use with the governor sheave 18 of the governor assembly 16 is illustrated. As shown, the overspeed assembly 30 includes a rod 32 coupled at a first end 34 to a movable portion of the governor sheave 18, and more specifically to a portion of the centrifugal mechanism 28, such as a centrifugal element 29 for example. In an embodiment, the outward radial movement of the centrifugal elements 29 results in movement of the rod 32. In the illustrated, non-limiting embodiment, the rod 32 is oriented generally parallel to an axis of rotation R of the centrifugal mechanism 28 and governor sheave 18 and is configured to translate along the axis R. However, embodiments where the rod 32 is oriented at another angle relative to the axis of rotation R are also contemplated herein. The rod 32 may be formed from any suitable material, including but not limited to plastic for example.

A pin 36 extends through an opening formed in the body of the rod 32, in an orientation generally perpendicular to the axis of rotation R of the centrifugal mechanism 28. The pin 36 may be formed from any suitable material, such as plastic or metal for example. A head 38 arranged at a first end of the pin 36 has a diameter greater than the diameter of the opening formed in the rod 32. As a result, engagement between the head 38 and the rod 32 limits movement of the pin 36 relative to rod 32 in a first direction. A primary magnet 40, such as a permanent magnet for example, is mounted to a second, opposite end of the pin 36. Similarly, the magnet 40 has a diameter greater than the diameter of the opening formed in the rod 32. As a result, engagement between the magnet 40 and the rod 32 limits movement of the pin 36 relative to rod 32 in a second, opposite direction.

Mounted within the hoistway generally adjacent the second end of the pin 36 is a secondary magnet 42. In an embodiment, the magnet 42 is an electromagnet. However any suitable type of magnet 42 is within the scope of the disclosure. The magnet 42 is selectively operable to generate a magnetic force configured to either attract or repel the magnet 40 coupled to the second end of the pin 36. This attraction or repulsion is used to move the pin 36 between a first position (FIGS. 3 and 4) and a second position (FIGS. 5 and 6) relative to the rod 32. The desired position of the pin 36 may be selected, for example, based on a direction of travel of the elevator car 12. In the illustrated, non-limiting embodiment, the pin 36 is in the first position when the elevator car 12 is travelling in a first, downward direction and is in the second position when the elevator car 12 is travelling in a second, upward direction within the hoistway.

The governor assembly 16 includes a bell crank lever 44 mounted within the hoistway at a position offset from the centrifugal mechanism 28 by a distance. As a result, the rod 32 is positioned generally between the centrifugal mechanism 28 and the bell crank lever 44. As shown, the bell crank level 44 includes an integrally formed first portion 46 and second portion 48. In the illustrated, non-limiting embodiment, the first portion 46 is oriented substantially parallel to the pin 36 and the second portion 48 is oriented substantially parallel to the rod 32 such that the interface 50 between the first portion 46 and the second portion 48 defines a bend in the bell crank lever 44. A distal end 52 of the second portion 48 of the bell crank lever 44 is pivotally coupled to a connector 54 associated with a release lever (not shown) and a first overspeed actuation switch 56. In addition, the bell crank lever 44 is configured to pivot about an axis X (best shown in FIG. 4) defined at the interface 50 between the first and second portions 46, 48 and oriented generally perpendicular to both the rod 32 and pin 36.

Figure 4:
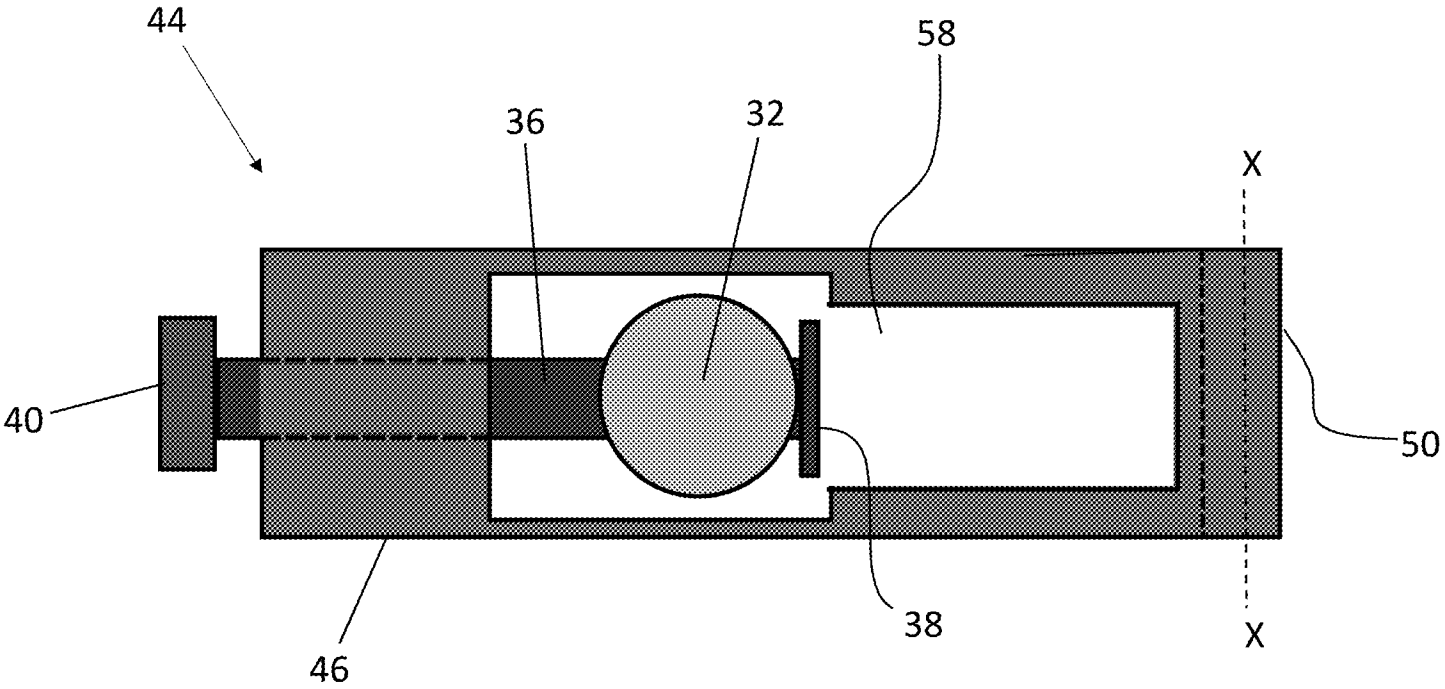
FIG. 4 is an end view of the bell crank lever of the overspeed assembly of FIG. 3 according to an embodiment.
Figure 6:
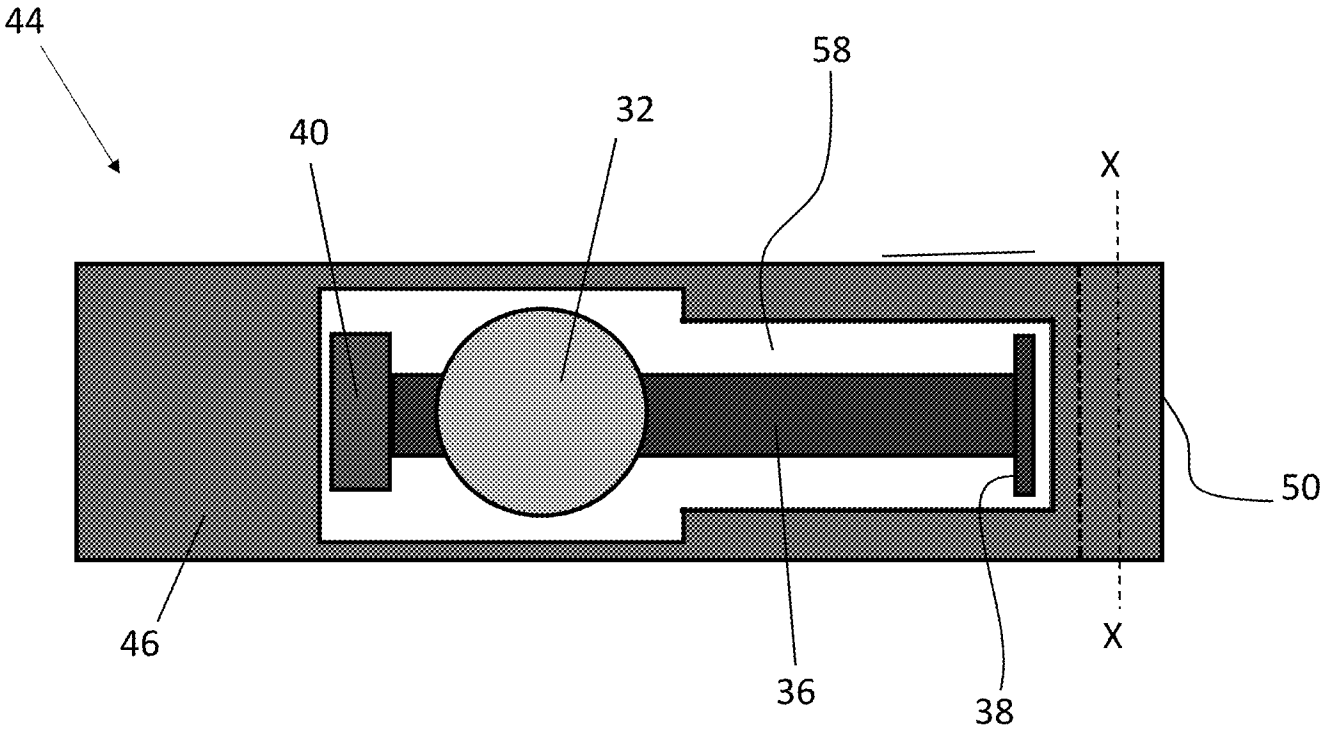
FIG. 6 is an end view of the bell crank lever of the overspeed assembly of FIG. 5 according to an embodiment.

In an embodiment, best shown in FIGS. 4 and 6, a cutout or through hole 58 is formed in the first portion 46 of the bell crank lever 44. The cut out 58 is generally equal or larger in length and width than the pin 36 including both the head 38 and the magnet 40. In the illustrated, non-limiting embodiment, the through hole 58 is positioned adjacent the interface 50 between the first and second portions 46, 48. Accordingly, the through hole 58 is generally aligned with the pin 36 when the pin 36 is in the second position.

Figure 3:
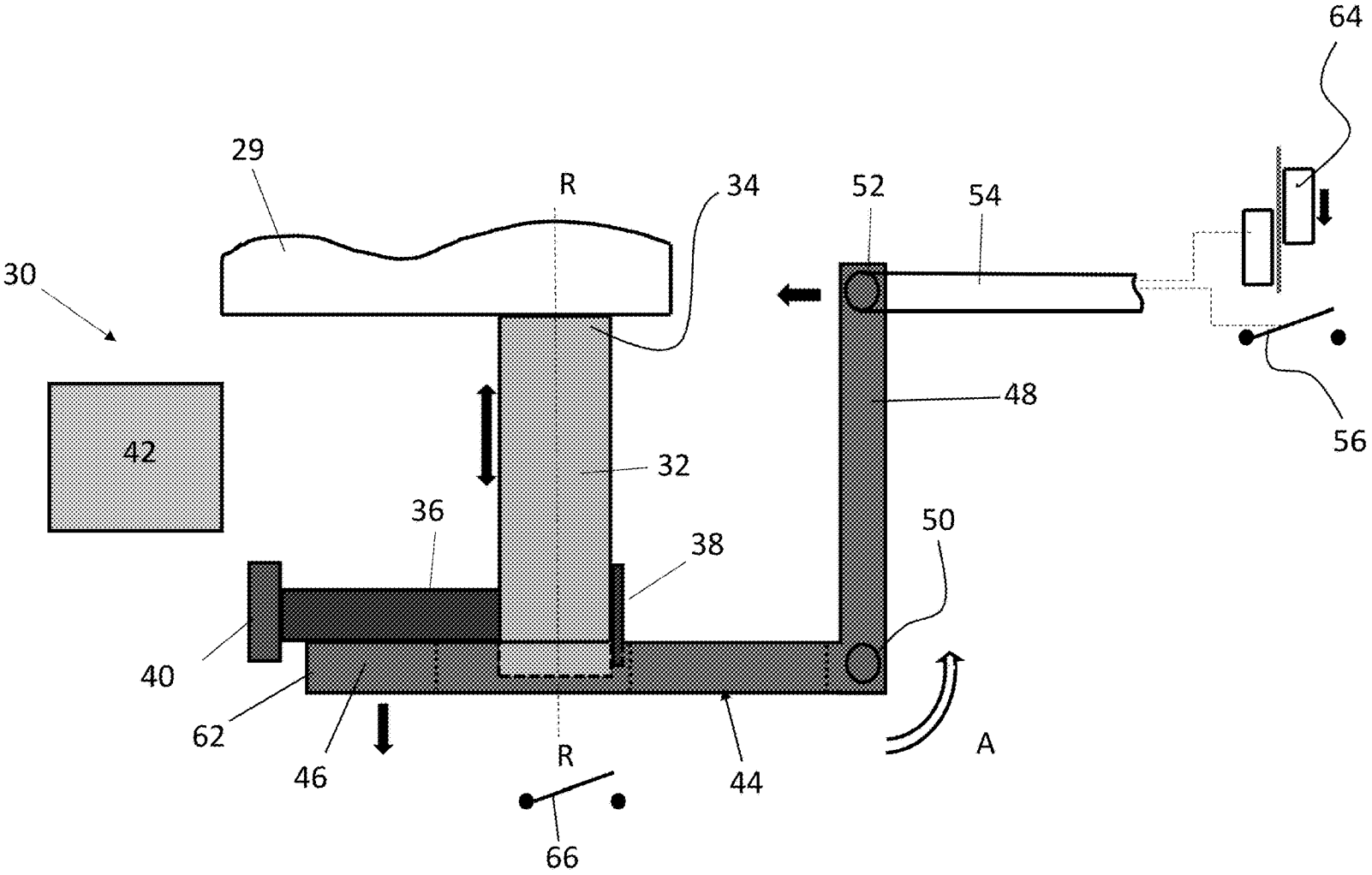
FIG. 3 is a plan view of an overspeed assembly of an elevator system in a first position according to an embodiment.

With specific reference now to FIGS. 3 and 4, upon determining that the car 12 is configured to move in a first direction, such as a downward direction for example, a controller 60 (FIG. 2) operably coupled to the secondary magnet 42 communicates a signal to the magnet 42, or a power source associated therewith. As a result, the secondary magnet 42 is energized and the resulting magnetic field has an opposite polarization as the magnetic field of the magnet 40 mounted to the pin 36. The interaction between the magnetic fields of the primary and secondary magnets 40, 42 causes the pin 36 to translate within the opening, relative to the rod 32, to a first position. In the first position, the head 38 of the pin 36 may be arranged generally adjacent or in direct contact with a surface of the rod 32. Further, in the illustrated, non-limiting embodiment, the length of the pin 36 is selected such that the second end or magnet 40 of the pin 36 extends axially beyond the free end 62 of the first portion 46 of the bell crank lever 44 when in the first position. Accordingly, in the first position, the pin 36 is not aligned with the through hole 58 formed in the first portion 46 of the bell crank lever 44.

As the speed of the elevator car 12 travelling in the first direction increases, the distance that the rod 32 extends from the governor sheave 18 also increases. Accordingly, the distance between the rod 32 and the bell crank lever 44 similarly decreases. If the speed of the elevator car 12 travelling in the first direction exceeds a first overspeed threshold, the movement of the rod 32 causes the pin 36 to apply a force to the first portion 46 of the bell crank lever 44. This force rotates the bell crank lever 44 about its axis X, as indicated by arrow A, such that a corresponding force is applied to the connector 54 to operate the overspeed switch 56. Operation of the switch 56 may be configured to interrupt the power being supplied to a motor 57 (see FIG. 2) driving movement of the elevator car 12 within the hoistway and/or apply a brake 59 to the motor 57 to slow movement of the elevator car 12.

If the speed of the elevator car 12 travelling in the first direction exceeds a second overspeed threshold, the further movement of the rod 32 relative to the centrifugal mechanism 28, and the resulting engagement between the pin 36 and the bell crank lever 44, causes the bell crank lever 44 to rotate further about its axis X, in the direction indicated by arrow A. This further rotation causes the connector 54 to operate a jaw mechanism, illustrated at 64 in FIG. 2, and initiate engagement of the elevator safeties. Through this activation, one or more elevator safeties are moved into frictional engagement with the guide rails 14 supporting the elevator car 12, as is known in the art.

Because the distance that the rod 32 extends from the governor sheave 18 and/or centrifugal mechanism 28 also increases as the speed of the elevator car 12 increases and engagement between the pin 36 in the first position and the bell crank lever 44 is used to indicate an overspeed condition, the distance between the centrifugal mechanism 28 and the first portion 46 of the bell crank lever 44 is selected based on the threshold of the first overspeed condition. Accordingly, the position of the bell crank lever 44 may be located either closer to or further from the centrifugal mechanism 28 to reduce or increase the threshold of the first overspeed condition, respectively. Alternatively, or in addition, because the radial movement of the centrifugal elements 29 is configured to control the translation of the rod 32 relative to the bell crank lever 44, this movement of the centrifugal elements 29 may be controlled to achieve a desired threshold of the first overspeed condition.

Figure 5:
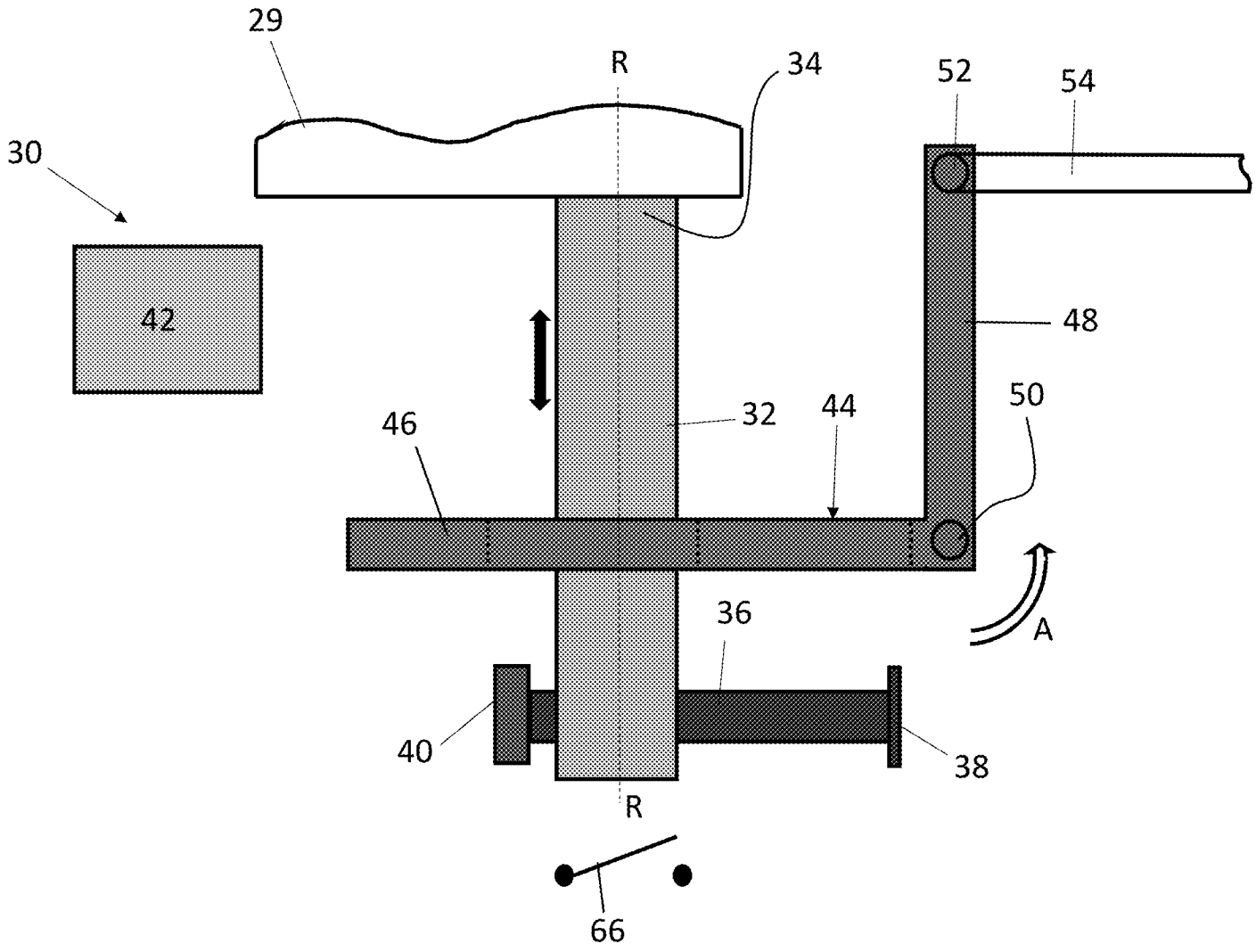
FIG. 5 is a plan view of an overspeed assembly of an elevator system in a second position according to an embodiment.

With reference to FIGS. 5 and 6, upon determining that the car 12 is configured to move in a second direction, such as an upward direction for example, the controller 60 generates a signal to energize the secondary magnet 42 and create a magnetic field with a similar polarization to the magnet 40 affixed to the pin 36. The interaction between the magnetic fields of the magnets 40, 42 causes the pin 36 to translate within the opening, relative to the rod 32, to the second position. In the second position, the magnet 40 of the pin 36 is arranged generally adjacent or in direct contact with a surface of the rod 32. Further, in the second position, the pin 36 is generally aligned with the through hole 58 formed in the first portion 44 of the bell crank lever 46.

As the speed of the elevator car 12 moving in the second direction increases, the distance that the rod 32 extends from the centrifugal mechanism 28 also increases. The rod 32 is configured to move in the same direction relative to the centrifugal mechanism 28 regardless of whether the elevator car 12 is moving in the first direction or the second direction. Because the threshold associated with an overspeed condition during movement of the elevator car 12 in the second direction is greater than the threshold associated with an overspeed condition during movement of the elevator car 12 in the first direction, the rod 32 and pin 36 will be received within and ultimately extend through the through hole 58 formed in the bell crank lever 44.

As the speed of the elevator car 12 travelling in the second direction increases, and ultimately exceeds a threshold associated with an overspeed condition, the distal end of the rod 32 will contact an overspeed switch 66. Operation of the overspeed switch 66 will activate or drop the machine brake and interrupt power to the machine motor, as is known in the art.

The position of the overspeed switch 66 relative to the centrifugal mechanism 28 and the movement of the rod 32 is selected based on the threshold of the overspeed condition when the elevator car is travelling in the second direction. Accordingly, the position of the overspeed switch 66 may be located either closer to or further from the centrifugal mechanism 28 to reduce or increase the threshold of the overspeed condition, based on earlier or later actuation by the rod 32.

The overspeed assembly 30 illustrated and described herein provides a first overspeed threshold for travel of an elevator car 12 in a first direction and a second, distinct overspeed threshold for travel of an elevator car 12 in a second, opposite direction. In an embodiment, the first overspeed threshold for travel in the down direction is between 8 and 10 m/s and the second overspeed threshold for travel in the up direction is between 12 and 18 m/s. However, any speeds are within the scope of the disclosure. Further, governor assemblies 16 in an existing elevator system may be adapted to include the overspeed assembly 30 with minimal changes to the existing components.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An overspeed assembly for use with a governor assembly for limiting of an elevator system, the overspeed assembly comprising:

a rod movable relative to the governor assembly in response to a speed of an elevator car;

a pin coupled to the rod, the pin being movable between a first position and a second position based on a direction of travel of the elevator car, wherein the pin is configured to engage a first component to indicate a first overspeed condition when the elevator car is travelling in a first direction and the pin is configured to engage a second component to indicate a second overspeed condition when the elevator car is travelling in a second, opposite direction, wherein the pin is movable between the first position and the second position in response to a magnetic field of the overspeed assembly.

2. The overspeed assembly of claim 1, wherein the first overspeed condition and the second overspeed condition are distinct.

3. The overspeed assembly of claim 1, wherein the pin is oriented substantially perpendicular to the rod.

4. The overspeed assembly of claim 1, wherein the elevator car is travelling in the first direction, the pin is in the first position and when the elevator car is travelling in the second direction, the pin is in the second position.

5. The overspeed assembly of claim 1, wherein the pin further comprises a first magnet, and the overspeed assembly includes a second magnet, the magnetic field generated by the second magnet being selectively operable to attract and repel the first magnet to move the pin between the first position and the second position.

6. The overspeed assembly of claim 5, further comprising a controller operably coupled to the second magnet, wherein the controller energizes the second magnet to attract and repel the first magnet in response to a direction of travel of the elevator car.

7. The overspeed assembly of claim 1, wherein the governor assembly further comprises:

a governor sheave; and a centrifugal mechanism movably mounted to the governor sheave, the rod being connected to the centrifugal mechanism.

8. The overspeed assembly of claim 7, wherein the governor assembly further comprises a bell crank lever offset from governor sheave by a distance.

9. The overspeed assembly of claim 8, wherein the bell crank lever is the first component.

10. The overspeed assembly of claim 9, further comprising a switch operably coupled to the bell crank lever, wherein when the elevator car is travelling in the first direction in the first overspeed condition, the pin engages the bell crank lever to operate the switch.

11. The overspeed assembly of claim 10, further comprising a motor for driving movement of the elevator car, wherein the switch is configured to at least one of interrupt a supply of power to the motor and apply a brake to the motor.

12. The overspeed assembly of claim 8, wherein the bell crank lever includes a through hole, the pin being receivable within the through hole when the pin is in the second position.

13. The overspeed assembly of claim 12, further comprising a switch positioned adjacent the bell crank lever, wherein when the elevator car is travelling in the second direction in the second overspeed condition, the pin operates the switch.

14. The overspeed assembly of claim 9, further comprising an elevator safety operably coupled to the bell crank lever wherein when the elevator car is travelling in the first direction in a third overspeed condition, the pin engages the bell crank lever to engage the elevator safety.

* * * * *